United States Patent [19]

Desarzens

[11] 3,939,689

[45] Feb. 24, 1976

[54] METHOD AND APPARATUS FOR DISTINGUISHING APERIODIC NOISE INPUT SIGNALS FROM PERIODIC INPUT SIGNALS DURING MEASUREMENT

[75] Inventor: Pierre Desarzens, Bienne, Switzerland

[73] Assignee: Omega, Louis Brandt & Frere S.A., Bienne, Switzerland

[22] Filed: Sept. 29, 1972

[21] Appl. No.: 293,642

[30] Foreign Application Priority Data

Oct. 5, 1971 Switzerland ..... 14552/71

[52] U.S. Cl. ..... 73/6

[51] Int. Cl.[2] ..... G04B 17/00

[58] Field of Search ..... 73/6; 324/186, 189, 191; 235/92 EV

[56] References Cited

UNITED STATES PATENTS

| | | | |
|---|---|---|---|
| 2,931,217 | 3/1960 | Wendt | 73/6 |
| 3,238,764 | 3/1966 | Greiner | 73/6 |
| 3,370,456 | 2/1968 | Jucker | 73/6 |
| 3,407,645 | 10/1968 | Jucker | 73/6 |
| 3,678,252 | 7/1972 | Payne | 235/92 EV |
| 3,777,547 | 12/1973 | Izumi | 73/6 |
| 3,868,845 | 3/1975 | Shimizu | 73/6 |

*Primary Examiner*—S. Clement Swisher
*Attorney, Agent, or Firm*—Imirie, Smiley & Linn

[57] ABSTRACT

A method and apparatus for detection whether an input signal is periodic or aperiodic, wherein reference pulses at a constant frequency are added during a first interval determined by a number of cycles of the input signal and reference pulses at the same frequency are substracted during a second interval determined by an equal number of cycles of the input signal. If the input signal is periodic, the counting result is zero or nearly zero since the counting intervals have been of equal duration. If the input signal is aperiodic, the counting result differs from zero because the counting intervals have not been of equal duration.

6 Claims, 4 Drawing Figures

TIME-PIECE
PICK-UP
PULSE FORMER AND AMPLIFIER
15
SYNCHRONIZING CIRCUIT
D Q
CP
M
FREQUENCY DIVIDERS
A
B
1a
1
2
3
5
6
REFERENCE OSCILLATOR
BT
4
COUNTER
8
TR
US
11'
REVERSIBLE COUNTER
9
MEMORY
10
11
SELECTOR CIRCUIT
12
COMPLE-MENTARY CIRCUIT
13
MEMORY
ME13
14
DISPLAY UNIT
ME10
RZ9
R8
7
CONTROL CIRCUIT

C
ti
ti+1
ti+2
ti+3
ti+4
15
Si
Si+1
Si+2
Si+3
Si+4
A
B

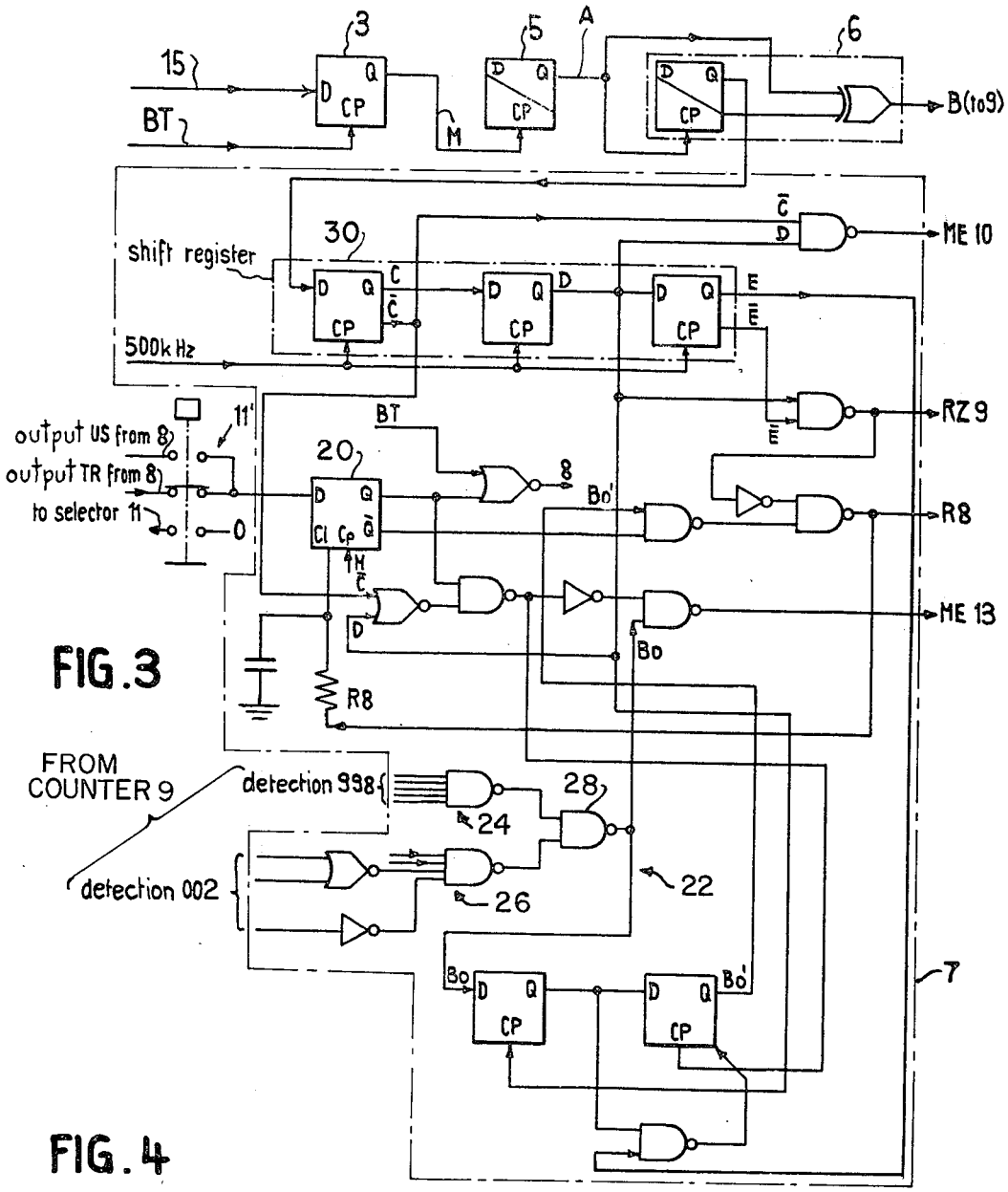
FIG. 3
FIG. 4
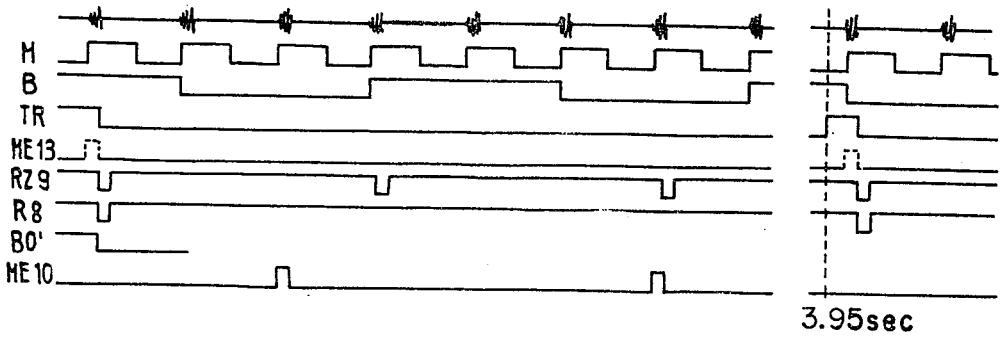

METHOD AND APPARATUS FOR DISTINGUISHING APERIODIC NOISE INPUT SIGNALS FROM PERIODIC INPUT SIGNALS DURING MEASUREMENT

BACKGROUND OF THE INVENTION

1. Field of the Invention

This invention relates to a method and apparatus for distinguishing aperiodic noise input signals from periodic input signals during measurement, and is of particular utility for analysis of the operation of a timepiece.

2. Description of the Prior Art

In certain prior systems for measuring the accuracy of a running timepiece, the oscillating cycle of a time-keeping resonator, for instance of a balance wheel, tuning fork or the like is compared with the cycle of a reference oscillation. It is thus possible to determine whether the oscillating cycle of the time-keeping resonator is correct or not.

In another prior measuring system, the number of cycles of a high frequency reference oscillator is counted during one cycle or a small number of cycles of the oscillation of a balance wheel of a watch to be tested. In this system the counting time is determined by means of a microphone which detects the noise of the escapement driving the balance wheel, the amplified pulses from the microphone being used for starting and stopping counting of the reference frequency. However, in such a system, not only the desired periodic pulses produced by the escapement but also background noises may be detected by the microphone, it being difficult to eliminate such parasitic noises which are often sensed by the system as the beginning or end of the counting interval thereby falsifying the measuring result.

SUMMARY OF THE INVENTION

It is an object of this invention to provide simple and efficient means for distinguishing periodic input signals from aperiodic input signals so that measuring results falsified by aperiodic noise input signals may be eliminated, while correct measuring results based on periodic input signals may be indicated. According to this invention distinction between aperiodic and periodic signals is achieved by a method wherein reference pulses of a constant frequency are added during a predetermined number of cycles determined by input signals and that afterwards reference pulses of said constant reference frequency are subtracted during an equal number of cycles determined by input signals, the presence of a periodic or aperiodic signal being detected according to whether the result of said subsequent addition and subtraction of reference pulses is at least approximately equal to zero or substantially differs from zero.

This invention will now be explained in detail with reference to the drawing which schematically illustrates, by way of example, an apparatus allowing distinction between periodic and aperiodic signals.

BRIEF DESCRIPTION OF THE DRAWINGS

FIG. 3 is a detailed schematic diagram of the control circuit of FIG. 1; and FIG. 4 is a second set of curves showing signals at various points in the control circuit of FIG. 3.

DESCRIPTION OF THE PREFERRED EMBODIMENT

Figure 1:
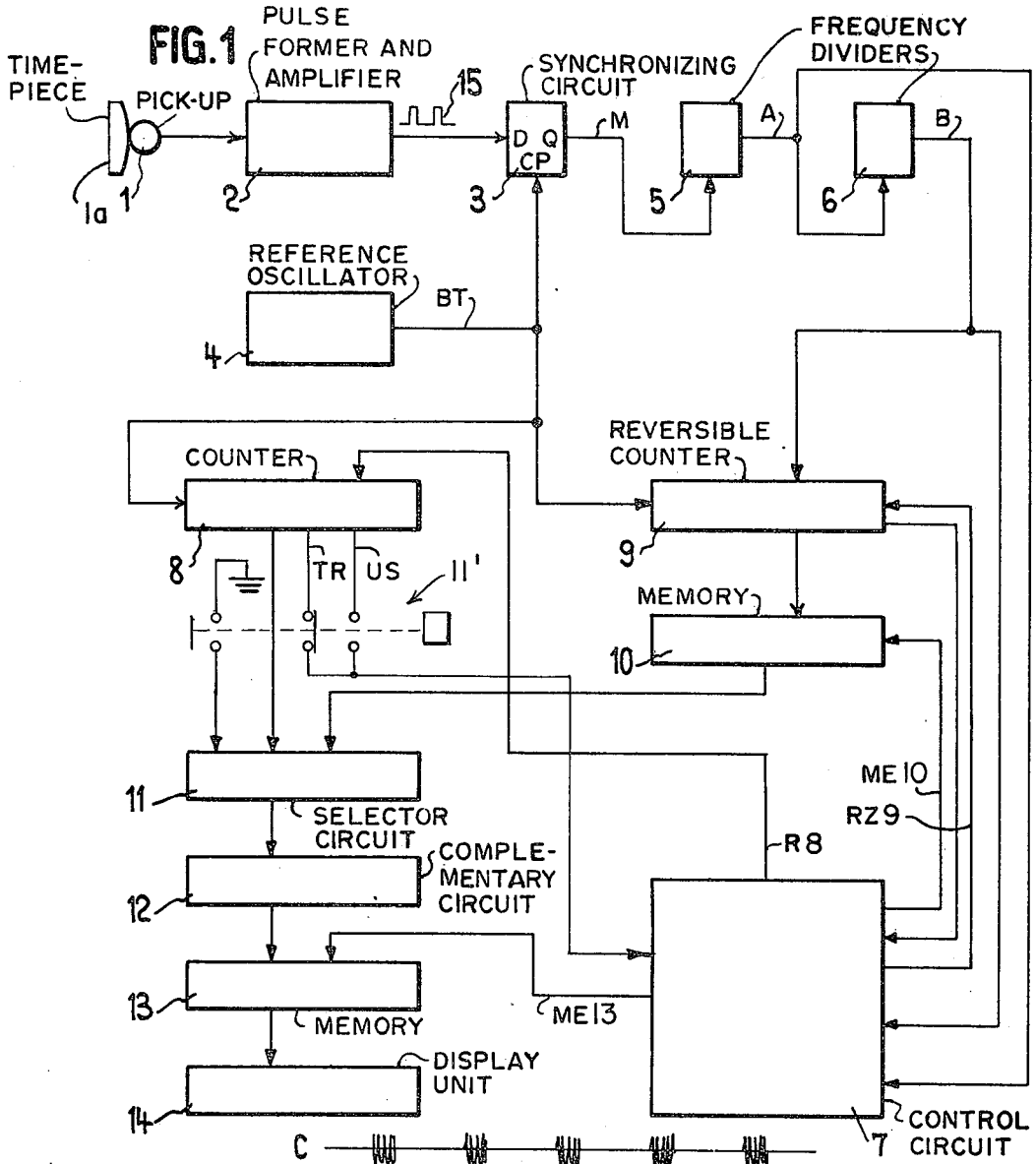
FIG. 1 is a block diagram of a preferred embodiment of apparatus for distinguishing aperiodic noise input signals from periodic input signals in accordance with the present invention.
Figure 2:
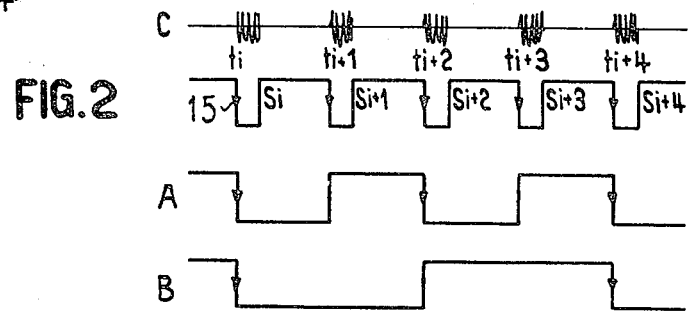
FIG. 2 is a set of curves representing signals at various points in the apparatus of FIG. 1.

Referring specifically to the drawings, and particularly FIG. 1 thereof, the present apparatus includes an electro-acoustical transducer, such as a piezoelectric microphone 1, which is placed in proximity with a timepiece 1a for receiving the periodic ticking signals produced by the escapement of the watch during operation. This method of detecting signals representing the operation of the escapement of a watch is generally known in the art, as shown in U.S. Pat. No. 3,370,456 to E. Jucker. The output signal of the microphone 1 is shown at C in FIG. 2, this signal being applied to a pulse former and amplifier 2. The output signal of amplifier 2 is represented by curve 15 in FIG. 2 and is synchronized in a synchronizing circuit 3, which may be a D-flip-flop (delay flip-flop), for example, with the output signal of a stable reference oscillator 4, such as a quartz controlled oscillator, which serves as a time base. The output frequency of oscillator 4 substantially exceeds the frequency of signal 15, with the leading edge of each output pulse of circuit 3 synchronized with a pulse from oscillator 4. Thus, the output signal of circuit 3 is similar to that of curve 15, as shown by curve M in FIG. 2, and is applied to a two-stage frequency divider 5 and 6. Signal M is divided by a factor of 2 in each divider stage, and their respective output signals, shown at A and B in FIG. 2, are each applied to inputs of a control circuit 7. Circuit 7 has a number of control outputs, one of which being connected to a reversible counter 9 serving to determine whether the input signal is periodic or aperiodic in a manner set out below. Another counter 8 has a counting input connected to the output of oscillator 4 and receives a control input from circuit 7 such that counter 8 counts the number of reference pulses occurring during an integral number of cycles of the balance wheel. A memory 10 stores the counting result of counter 9 for a purpose set out later.

A selector circuit 11 allows selection of various results for display or registration. A switch 11' for control of of selector circuit 11 will be explained below with reference to FIG. 3. A complementary circuit 12 may serve for converting or processing the outputs of counters 8 and 9 for display or registration. Another memory 13 stores the values to be transmitted to a display unit 14.

In operation, the periodic sounds produced by the escapement of the watch are converted into an electrical signal as indicated at C in FIG. 2. These signals are formed into pulses by the pulse-forming amplifier 2. As set out above, the output pulses from amplifier 2 are now synchronized in circuit 3, that is, the leading edges of the pulses are synchronized with reference pulses form the oscillator 4. The output signal M from synchronizing circuit 3 is divided in the divider stages 5 and 6, whereby signals A and B (FIG. 2) are obtained at the outputs of dividing stages 5 and 6, respectively. These signals, A and B, are transmitted to the control circuit 7 which controls the counter 9 to add or count pulses received from the reference oscillator 4 during a first time interval, from $t_i$ to $t_{i+1}$, corresponding to one half cycle of the balance-wheel oscillation. The counter 9 is then controlled for subtraction of pulses transmitted thereto from oscillator 4 during a second time interval, from $t_{i+1}$ to $t_{i+3}$, corresponding to two half cycles of the balance-wheel oscillation. Then the counter 9 is controlled to add again pulses during the time interval from $t_{i+3}$ to $t_{i+4}$ corresponding to another half cycle of the balance wheel oscillation. For the usual periodic signal detected from the balance-wheel oscillation, the counting result should be zero or at least approximately zero, because addition and subtraction of pulses has taken place during equal time intervals of two half cycles or one full cycle each. If an aperiodic disturbing or noise pulse occurs, it is obvious that the periodic control signals A and B will be disturbed and will become aperiodic, the addition and subtraction by counter 9 being now done during time intervals of different lengths so that the counting result will substantially differ from zero.

Only if the counting result of counter 9 is zero or nearly zero, thus proving that the analyzed signal M is periodic and does not contain disturbing noise pulses, will the counting result of counter 8 be transmitted through circuits 11 to 13 to the display unit 14. Since counter 8 will have added reference pulses during the full time interval from $t_i$ to $t_{i+4}$, the displayed output therefrom will be accurately indicative of the rate of the watch under test.

If the counting result in counter 9 differs substantially from zero, thus indicating that an aperiodic disturbing or noise signal has occurred, the counting result of counter 8 will not be transmitted but is reset to zero, and another measuring cycle may automatically or manually be started. A next measurement will usually not be disturbed by an aperiodic noise pulse and will then automatically be transmitted from counter 8 to the display unit. Therefore, it can be appreciated that only when the counting result of counter 8 is recognized or confirmed to be valid by a counting result of zero or nearly zero by counter 9, will the result of counter 8 be transmitted for display.

A second measuring operation may be effected with the circuit as shown in FIG. 1, if the selector 11 and control circuit 7 are so adjusted that the counting result of counter 9 during the first half of the counting interval, that is during an interval from $t_i$ to $t_{i+2}$ is stored in the memory 10. As set out above, the counter 9 adds pulses during a first half cycle from $t_i$ to $t_{i+1}$ and subtracts pulses during an interval which includes a second half cycle from $t_{i+1}$ to $t_{i+2}$. This counting result, which should usually be zero, enable the determination of whether the escapement is "in beat"; that is, whether or not the functions of the escapement are symmetrical in relation to its rest position. If the functions are not symmetrical, this is will be indicated by a counting result differing from zero during the time interval of $t_i$ to $t_{i+2}$.

In a modified embodiment of the apparatus, analog circuits may be provided in place of counters and 9 for analog comparison of the time intervals instead of digital comparison by counting pulses. As an example, a condenser replacing counter 9 may be charged and discharged alternatively by a current source during the above time intervals to be compared with each other, an indication being thus obtained of whether the signal has been periodic or aperiodic by the residual charge of the condenser which should be zero or nearly zero if the signal is periodic.

The apparatus may also be used for measurement or checking the amplitude of the balance wheel. To this end the duration of pulses M (FIG. 2) is measured by counting the number of reference pulses during a time interval from $t_i$ to Si, this time interval and counting result respectively being inversely proportional to the amplitude of the balance wheel. The number of reference pulses may also be counted during a number of cycles of signal M in order to measure a mean value of the amplitude.

FIG. 3 illustrates the most important parts of a typical control circuit 7, with circuits 3, 5 and 6 also illustrated in order to understand their cooperation with the control circuit. This circuit will not be fully described in all details because from the symbols and wiring the expert in the art of logical circuits will be able to check the circuit and its operation in detail. The circuit has an input selector switch 11′ also shown in FIG. 1 as being associated with a selector circuit 11. Outputs TR and US, which may selectively be connected to an input flip-flop 20 of circuit 7, are connected to outputs of decoding circuits within counter 8. Output US from counter 8 becomes effective when the counter 8 has reached a predetermined counting result. Similarly, output TR from counter 8 becomes effective when the counter reaches a counting result corresponding to a time interval of nearly 4 seconds, for instance 3.95 seconds. Signal TR is shown in FIG. 4.

Another decoding system is shown at 22 having a number of inputs connected to terminals of counter 9 and serving for decoding counting results differing but slightly from zero. As shown in FIG. 3, a first circuit 24 is operative for results below 998 in the last three decimals of counter 9, while a second circuit 26 is operative for counting results exceeding 002 in the last three decimals. If both decoded signals are "inoperative", that is, if the counting result does not exceed 002 and is not lower than 998, a signal Bo confirming that a periodic signal M has been received is issued by the output NAND-gate 28 of the system, this signal being transformed into a signal Bo′ as shown in FIG. 4. A shift register 30 or sliding register produces time-shifted auxiliary control pulses from an auxiliary output of divider stage 6. Output gates of the control circuit produce signals ME 10 for transmitting counting results from counter 9 to memory 10 and ME 13 for transmitting counting results from counter 8 or from memory 10 to memory 13, such results being displayed by display unit 14 as soon as shifted to memory 13. Another output produces a control signal R8 by which resetting of counter 8 to zero is effected. Output signal RZ 9 effects resetting of counter 9 to zero.

For measurement of the instantaneous rate of the watch, with switch 11′ in the position as shown, counter 9 is controlled by signal B to alternatively add pulses at reference frequency or time-base frequence BT during two half cycles each. However, with the control circuit shown by way of example in FIG. 3, counting by counter 9 will only be displayed after a delay time corresponding to 4 seconds when signal TR arrives through switch 11′ from counter 8 which has counted reference pulses during a period corresponding to nearly 4 seconds. As seen from FIG. 4, counter 9 is periodically reset by signal RZ 9 such that each counting cycle includes addition of pulses during one half cycle of the balance wheel oscillation, subtraction of pulses during the following two half cycles of the balance wheel oscillation, and addition of pulses during a fourth half cycle as set out above. At the end of the measuring interval of 4 seconds, and if Bo confirms that a periodic signal has been measured during the last counting cycle of counter 9, a pulse ME 13 is issued whereby the result from counter 8 is shifted into memory 13 this result being now indicated by display 14. Counters 8 and 9 are then reset by pulses R8 and RZ9 respectively, and a new measuring interval of 4 seconds starts automatically. Measurement and counting of reference pulses into counter 8 during the 4 second interval allows the determination of an accurate average instantaneous rate of the watch. Further, the frequency of the reference oscillator may be so selected that at the end of the measuring cycle of 4 seconds, the counter 8 exactly shows the gain or loosing rate of the watch in integers. If the watch is too fast, a complementary number to the counting result of counter 8 may be formed in circuit 12 and transmitted to memory 13 for display.

When measuring whether or not the watch escapement is in beat or symmetrically operating, the counting result in counter 9, which is transmitted by a pulse ME 10 into memory 10 during each counting cycle after adding pulses during one half cycle and subtracting pulses during another half cylce of the balance wheel, will be transmitted into memory 13 by a pulse ME 13 and will appear on display 14 when pulse ME 13 occurs. Selector circuit 11 is set by the one contact of the selection switch 11' which has been reversed into its other position, in order to transmit the counting result from memory 10 instead of transmitting the counting result from counter 8 as described above for measurement of the rate of the watch. Further, since another output US of counter 8 is now connected to the control circuit, the measuring intervals will be shorter than 4 seconds, such that pulses ME 13 will be applied to memory 13 at a faster rate and counter 8 will be reset by pulses R8 at a faster rate.

What I claim is:

1. An apparatus for distinguishing aperiodic noise signals from period input signals comprising a pulse counter, a reference generator adapted to produce pulses at a constant reference frequency, an indicating unit adapted to indicate a measuring value, means for transmitting reference pulses from said generator to said pulse counter, a control circuit interconnected with said transmitting means and said pulse counter for controlling transmission and addition of reference pulses from said generator into said counter during a predetermined number of cycles of said input signals and for transmission and subtraction of reference pulses during an equal number of cycles of said input signals, and a memory for storing the results of the addition and subtraction of pulses in said counter, wherein said counter is controlled to add reference pulses during a half cycle of said input signals, to subsequently subtract reference pulses during a full cycle of said input signals, and then to add reference pulses during a half cycle of said input signals, the counting result of these operations being stored in said memory.

2. An apparatus for distinguishing aperiodic noise signals from period input signals comprising a pulse counter, a reference generator adapted to produce pulses at a constant reference frequency, an indicating unit adapted to indicate a measuring value, means for transmitting reference pulses from said generator to said pulse counter, a control circuit interconnected with said transmitting means and said pulse counter for controlling transmission and addition of reference pulses from said generator into said counter during a predetermined number of cycles of said input signals and for transmission and subtraction of reference pulses during an equal number of cycles of said input signals, and a memory for storing the results of the addition and subtraction of pulses in said counter, wherein said counter is controlled to add reference pulses during a first half cycle of said input signals and to subtract reference pulses during a subsequent half cycle of said input signals, the counting result being stored in said memory.

3. A method for measuring the instantaneous rate of a timepiece, wherein periodic input signals produced by the operation of the timepiece and possible aperiodic noise input signals are detected, comprising the steps of producing reference pulses of a constant frequency, counting such reference pulses during a first number of periods determined by said detected signals, subtracting reference pulses during a second number of periods equal to said first number of periods, measuring the rate of said timepiece, and transferring the result of the measurement of the rate of the timepiece to a display network in response to the total counting result during said first and second number of periods being approximately equal to zero.

4. A method according to claim 3, wherein said reference pulses are added during two half cycles of a periodic input source and that reference pulses are subtracted during two half cycles of said source.

5. A method according to claim 4, wherein reference pulses are added during a first half cycle of said source, that reference pulses are subtracted during the next two half cycles of said source, and that reference pulses are again added during a fourth half cycle of said source.

6. An apparatus for measuring the instantaneous rate of a timepiece comprising means for detecting periodic input signals produced by the operation of the timepiece and possible aperiodic noise input signals, accumulator means, a generator producing reference pulses at a stable frequency, program control means adapted to control said accumulator to add reference pulses during a predetermined number of periods determined by said input signals and to substract reference pulses during an equal number of periods, means for measuring the instantaneous rate of said timepiece and means for display of a measuring result therefrom, and means controllable by said accumulator for initiating transfer of a measuring result from said means for measuring the instantaneous rate to said display means when the accumulated count of said accumulator is approximately equal to zero.

* * * * *